US005358159A

United States Patent [19]

Lundie, Jr.

[11] Patent Number: 5,358,159

[45] Date of Patent: Oct. 25, 1994

[54] HOLSTER-TYPE HOLDER FOR ELECTRONIC COMMUNICATIONS EQUIPMENT

[76] Inventor: Edgar Lundie, Jr., 882 Brandlwood Way, NW., Lilburn, Ga. 30247

[21] Appl. No.: 73,454

[22] Filed: Jun. 7, 1993

[51] Int. Cl.[5] ..... A45F 5/00

[52] U.S. Cl. ..... 224/206; 224/203; 224/209; 224/245

[58] Field of Search ..... 224/192, 202, 203, 206, 224/209, 242, 243, 245, 254, 257, 258, 259, 260, 911

[56] References Cited

U.S. PATENT DOCUMENTS

| | | | |
|---|---|---|---|
| 1,037,717 | 9/1912 | Audley | 224/206 |
| 1,781,162 | 11/1930 | Clark | 224/206 |
| 2,037,132 | 4/1936 | Hoyt | 224/206 |
| 2,146,570 | 2/1939 | Gordon | 224/206 X |
| 2,396,118 | 3/1946 | Ohlemeyer | 224/206 |
| 2,579,782 | 12/1951 | Booth | 224/206 |
| 3,420,420 | 1/1969 | Clark | 224/243 |
| 3,648,906 | 3/1972 | Ross | 224/206 |
| 4,046,295 | 9/1977 | Eichler | 224/242 |
| 4,346,827 | 8/1982 | Bianchi et al. | 224/206 |
| 4,479,596 | 10/1984 | Swanson | 224/236 |
| 4,658,999 | 4/1987 | Hilty | 224/202 |
| 5,100,037 | 3/1992 | Kopyta et al. | 224/245 |
| 5,246,153 | 9/1993 | Beletsky | 224/192 |

*Primary Examiner*—Glenn T. Barrett
*Attorney, Agent, or Firm*—James A. Hinkle

[57] ABSTRACT

A personal communication shoulder holster has a soft, flexible shoulder strap which encircles the shoulder with a size and shape to support side carriage of a small soft communication case under a user's arm. The shoulder strap is adjustable in length and has resilient sections for adjustment and adaptability to body movement. Extended from the shoulder strap at a moveable position is an adjustable and pliant suspender strap which crosses the back and then goes over the other shoulder and clown the front of a user to a belt-hooking position at an opposite side from the communication case. The communication case is suspended from a bottom of the shoulder strap. An adjustable and pliant tie-down strap is suspended from a bottom of the communication case to a belt-hooking position. A flexible belt is provided for use with clothing that does not have a belt or edge at a waistline for attachment of the suspender strap and tie-down strap. An attachment ridge with an optional bead for retaining attachment clips is provided. A soft clip container and flexibility of the attachment ridge are optional to prevent harsh contact of the ridge or an attachment clip of a communication device. A small spring reel of strong, fine line can be attached to the communication case and to the communication device to prevent dropping or pickpocket conversion.

11 Claims, 2 Drawing Sheets

FIG.1
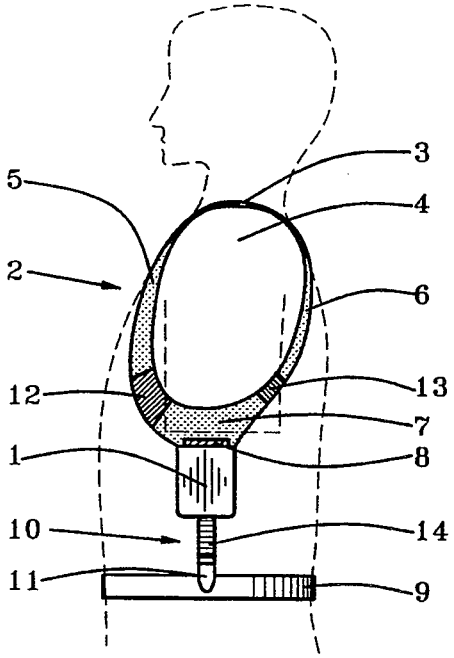
FIG.2
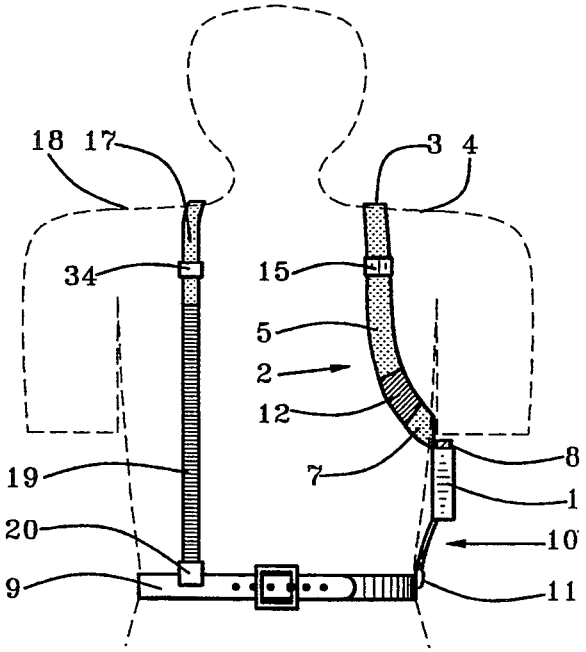
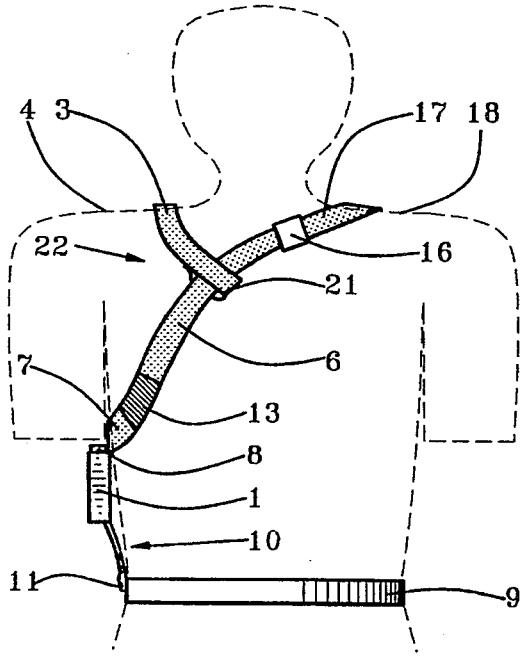
FIG.3
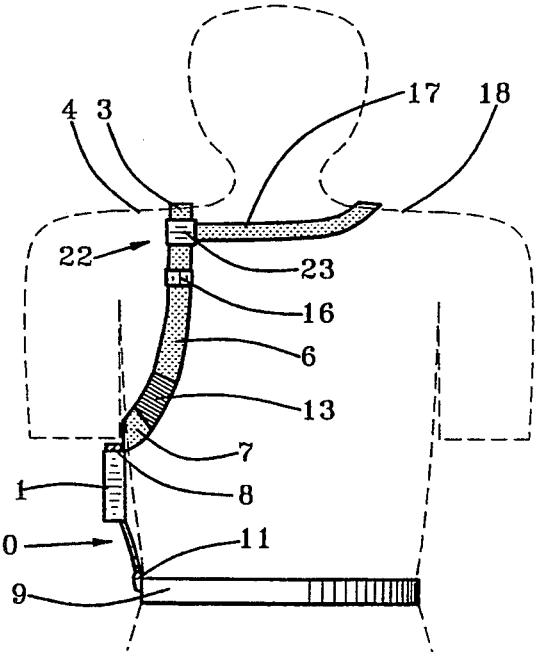
FIG.4

HOLSTER-TYPE HOLDER FOR ELECTRONIC COMMUNICATIONS EQUIPMENT

BACKGROUND OF THE INVENTION

I. Field of the Invention

The present invention generally relates to the field of shoulder holsters for carrying personal communications equipment such as a cellular telephone and an electronic pager.

II. Description of the Prior Art

Shoulder holsters arc used conventionally for carrying pistols and ammunition. The advent of cellular telephones, pagers and other personal communications devices, however, has created a need for a personal-communications shoulder holster. Different from firearm shoulder holsters, it must provide flexibility and convenience for use of a different type of equipment under different working conditions.

Mere combination of a shoulder strap for a pistol holster with a container for personal communication devices does not suffice. Known shoulder straps for pistol holsters have characteristics which make them unsuitable for use with a case or pocket for carrying personal communication devices. Opposite from flexibility and resilience with body movement for convenience and comfort in carrying personal communication devices, shoulder straps for firearm holsters are rigid to position a holster where a firearm can be grasped quickly and jerked out roughly. The manner in which pistol shoulder straps are attachable to a user's body and to a holster to achieve desired positional rigidity of the holster makes them bulky, heavy, inconvenient, irritable and inappropriate for carrying small communication devices.

Personal communication devices are used in environments such as medical facilities, social events, mobile offices, athletic activities, home and family conditions. Both genders use them regularly. Visibility is less important than convenience, comfort, aesthetics and adaptability to various human factors. Firearms, however, are used in relationship to rugged conditions that require adaptability to different physical and social conditions. So different are the use conditions that the necessary structural arrangement of a shoulder strap for a pistol holster would wear sores on a user of the same shoulder strap and attachments for communication devices. They would not be used and have not been used mostly because of such differences. Different structural relationships are required for separate use conditions.

Conventional carrying cases for paging devices do not provide the ease of access and yet reliability for a communications shoulder holster. An example of a carrying case for portable electronic paging devices is described in U.S. Pat. No. 4,470,506 granted to Swanson. The Swanson patent taught a rigid-walled container that tipped open when not held up by a flap over it. This is too bulky and sharp-edged for suspending under an arm from a shoulder strap. One's arm would have to be raised inconveniently to raise the flap and tip the container for accessing the case. Further, the direction in which it tipped did not position the contents in a normal direction of removal and replacement by a hand from an opposite side of one's body. It was designed instead to be hung on a belt and accessed from above instead of from a side angle as for an underarm position.

This case and others similar to it would not be appropriate for attachment to any type of shoulder strap.

Examples of previous firearm shoulder holsters and shoulder straps with which they are harnessed onto an individual are described in U.S. Pat. No. 1,037,717 granted to Audley, U.S. Pat. No. 1,781,162 granted to Clark, U.S. Pat. No. 2,396,118 granted to Ohlemeyer and U.S. Pat. No. 2,037,132 granted to Hoyt. Audley and Hoyt employed elaborate harness arrangements. Clark and Ohlemeyer both substituted elaborateness of a harness arrangement with a stiff, shaped shoulder strap. Either structure would be very inconvenient for the light-duty, soft and often visible carriage and use of small electronic communication equipment.

Further, shoulder straps for firearms are restricted by technical specification and by industrial information to use with firearm holsters. Non-obvious change from present shoulder-holster technology is required to structure the personal communication shoulder holster taught by this invention.

SUMMARY OF THE INVENTION

In accordance with the present invention, it is contemplated that in light of the problems that have existed and that continue to exist for the special conditions of carrying electronic personal communication equipment, objectives of this invention are to provide a personal communication shoulder holster which:

- Provides ease of access in a normal direction of a hand from one side to an underarm position on an opposite side of a user;
- Provides firm holding and yet easy removal of communication devices when and as desired;
- Is pliant with body movement;
- Is soft and rounded to avoid wearing irritation and impact injury;
- Is adjustable to different use conditions for the same individual or for different individuals; and
- Can be put on, taken off and placed easily in a hanging or folded condition.

This invention accomplishes the above and other objectives with a personal communication shoulder holster having a soft, pliable shoulder strap which encircles the shoulder with a size and shape to support side carriage of a small soft communication case under a user's arm. The shoulder strap is adjustable in length and has resilient sections for adjustment and adaptability to body movement. Extended from the shoulder strap at a moveable position is an adjustable and pliant suspender strap which crosses the back and then goes over the other shoulder and down the front of a user to a belt-hooking position at an opposite side from the communication case. The communication case is suspended from a bottom of the shoulder strap. An adjustable and pliant tie-down strap is suspended from a bottom of the communication case to a belt-hooking position. A pliant belt is provided for use with clothing that does not have a belt or edge at a waistline for attachment of the suspender strap and tie-down strap. An attachment ridge with an optional bead for attachment clips is provided. A soft clip pocket and flexibility of the attachment ridge are optional to prevent harsh contact of the ridge or an attachment clip of a communication device. A small spring reel of strong, fine line can be attached to the communication case and to the communication device to prevent dropping or pickpocket conversion of the communication device.

Other objects, advantages and capabilities of the invention will become apparent from the following description taken in conjunction with the accompanying drawings showing preferred embodiments of the invention.

BRIEF DESCRIPTION OF THE DRAWINGS

FIG. 1 is an elevation view taken from a side of a person. A person in mannequin form is illustrated in dashed lines;

FIG. 2 is a front view of the FIG. 1 illustration;

FIG. 3 is a rear view of the FIG. 1 illustration;

FIG. 4 is a rear view of an embodiment having contiguous front and back sections to which a suspender strap is attached at a moveable position;

DESCRIPTION OF THE PREFERRED EMBODIMENTS

Figure 5:
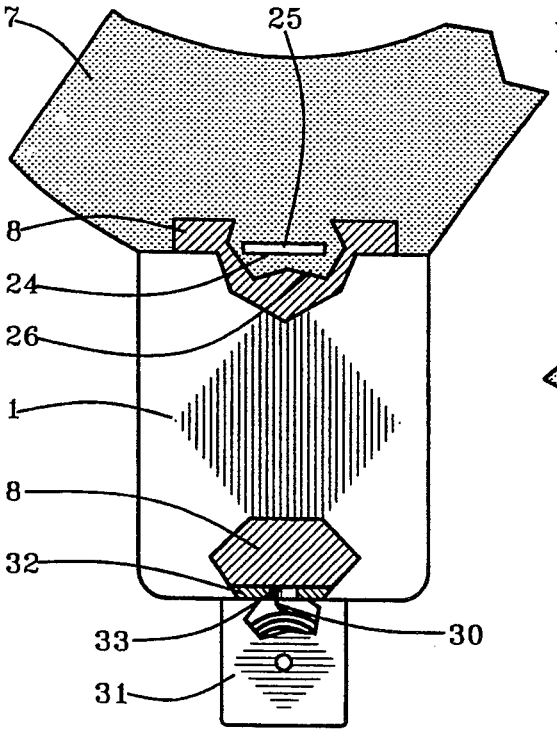
FIG. 5 is a sectional cutaway side view at a communications case. A spring reel is shown attached to the bottom of the case with a line from the reel to a communication device in the communications case.

Referring to the drawings wherein like reference numerals designate corresponding parts throughout the several figures, reference is made first to FIG. 1. A communications case 1 is attached to a shoulder strap 2. A top portion 3 of the of the shoulder strap 2 lays on a case-side shoulder 4 of an individual and supports a shoulder-strap front 5 and a shoulder-strap back 6 which encircle the case-side shoulder 3 and meet at a container-attachment section 7 of the shoulder strap 2. A communication device 8, such as an electronic pager or a cellular phone, is positioned in the communications case 1 which can be sized and shaped for either a particular form or a variety of forms of communication devices 8.

The communications case 1 can be anchored to a holster belt 9 with a case strap 10 if a user is not wearing a belt or clothes with waistline ridge to which the case strap 10 can be attached. If the user is wearing adequate clothing, the case strap 10 can be attached to it at the user's waistline if desired. Any of a variety of known belt-attachment fasteners 11 can be employed for attachment of the case strap 10 to the holster belt 9 or to other belts or clothing worn by a user.

A strap front resilient section 12 and a strap back resilient section 13 can be added as desired for flexibility with body movement and comfort of a user as desired. Also for flexibility and comfort, a case-strap resilient section 14 can be employed.

Reference is made now to FIGS. 1–4. In FIG. 2, front-length-adjustment strap fastener 15 is added as an option. A rear-length-adjustment strap fastener 16 can be employed also as shown in FIG. 4. Different from firearm shoulder holsters, front and rear adjustment of the shoulder strap 2 is particularly advantageous for a wider variety of forms of people who can benefit from use of this personal communication shoulder holster.

As depicted in FIG. 2, a suspender strap 17 is attachable to the holster belt 9 or other article of clothing and extended up over a suspender-side shoulder 18. The suspender strap 17 can have a suspender resilient section 19 and can be attached to the holster belt 9 or other article of clothing with a conventional suspender attachment 20.

In one embodiment, the suspender strap 17 crosses the back of a user as shown in FIG. 3 and is attached to the shoulder-strap back 6 such that the shoulder-strap-back 6 and the suspender strap 17 are joined contiguously. For this FIG. 3 embodiment, a shoulder-strap loop 21 in a top portion 3 of the shoulder strap 2 contains the shoulder-strap back 6 and the suspender strap 17 at a proximate position of where they are joined between the suspender-side shoulder 18 and the container-attachment section 7.

In an embodiment shown in FIG. 4 with a contiguous shoulder strap 2 instead of a contiguous suspender strap 17 and shoulder-strap back 6, the suspender strap 17 is extended across the back of the person from the suspender-side shoulder 18 to a moveable position 22 on the top portion 3 of the shoulder strap 2. A shoulder-strap fastener 23 is employed to attach the suspender strap 17 to the top portion 3 of the shoulder strap 2. The shoulder-strap fastener 23 can be in conjunction with a looped member slidable on the top section 3 of the shoulder strap 2 and attached to the suspender strap 17 or, alternatively, a selection of known attachment means can be employed. An embodiment with a contiguous shoulder strap 2 can be symmetrical for both left-handed and right-handed use and, with the length-adjustment straps 15 and 16, can be made adjustable to practically all individuals. One size can fit all.

The other embodiment with a contiguous suspender strap 17 and back strap 6 can be made to fit all sizes and both left-handed and right-handed users also. Some users will prefer either embodiment and some manufacturers may prefer either or both embodiments. Both provide convenience, comfort and other utilities not available previously.

Figure 6:
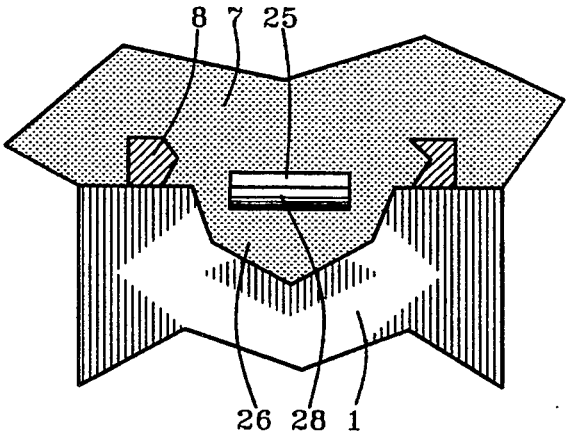
FIG. 6 is a sectional view which depicts an attachment-ridge bead on the communications case.
Figure 7:
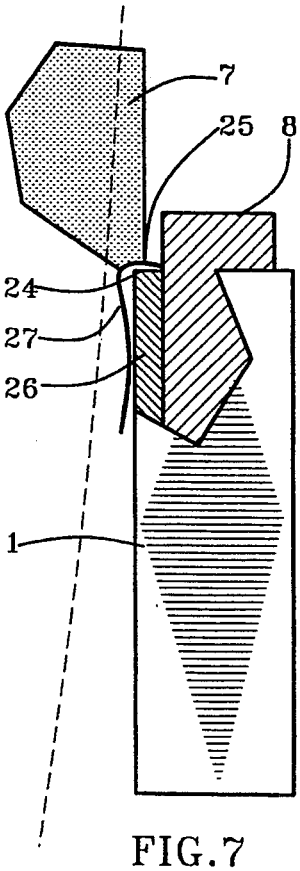
FIG. 7 is a cutaway view taken from a front of an individual.
Figure 8:
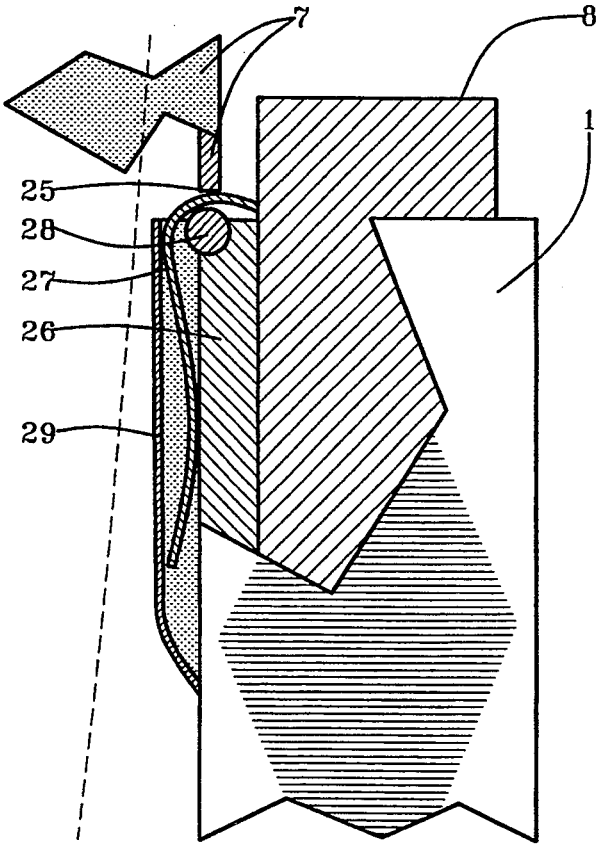
FIG. 8 is an exploded cutaway side view showing a beaded attachment ridge and a clip container.

Reference is made now to FIGS. 5–8 for more particularity in relation to communications case 1 and its containment of a communication device 8. An attachment ridge 24 can be a bottom side of a slit 25 similar to a button hole in container back side 26 which is attached to the container-attachment section 7. Most personal communication devices 8 are provided with a clip 27 that is insertional in the slit 25 and then biased against the container back side 26 in a grasping action that restrains the communication device 8 and prevents it from falling out of the communications case 1. A bead 28 on a bottom side of the slit 25 can be employed to retain the clip 27 more effectively. A pocket or a sleeve as a clip container 29 can be positioned on the container back side 26 to prevent contact of the clip 27 with clothing or with the body of a user.

To prevent pickpocket stealing or conversion of the communication device 8 and also to prevent it from dropping when being handled, the communication device 8 can be attached to the communications case 1 with a container line 30. The container line 30 can be reeled on a spring reel 31 which is attached preferably to a case bottom 32 and fed through line orifice 33. The container line 30 can be similar to fishing line, parachute cord, plastic-covered cable, link chain, ball chain or other line preferred by different individuals for different use conditions and different types of communication devices 8.

A suspender length adjuster 34 can be positioned as desired between the waistline end of the suspender strap and a shoulder-strap end of the suspender strap.

Material for construction of this personal communications shoulder holster can be any of a wide variety of flexible materials such as soft leather and fabric. Combinations of relatively soft and flexible materials can be used. Some can be relatively decorative to suit individual preferences.

A wide variety of combinations of optional components that comprise the embodiments of this invention can be employed. Foreseeable mathematical possibilities of combinations of components are numerous. Only a representative sample are included in the specification and in the claims which describe this invention.

Various modifications may be made of the invention without departing from the scope thereof and it is desired, therefore, that only such limitations shall be placed thereon as are imposed by the prior art and which are set forth in the appended claims.

What is claimed is:

1. A personal communication shoulder holster comprising:

a shoulder strap constructed of flexible material that is sized and shaped arcuately to lay on top of a shoulder, to encircle down a front side and under an arm to a position adjacent a side and to extend up against a back of the shoulder of a person, a suspender strap constructed of flexible material that is attachable to the shoulder strap at a moveable position and sized and shaped to extend from the back of the shoulder across the back, over an opposite shoulder and down an opposite side to a waistline of the person, a waistline attachment on a waistline end of the suspender strap, a communications case that is sized and shaped to contain a desired communication device and constructed of flexible material that is attachable to the shoulder strap at the position under the arm and adjacent the side of the person, the communications case having an entrance to accept the communication device therethrough, a case strap attachable to and extendable down from a bottom of the communications case to the waistline of the person, a waistline attachment on a waistline end of the case strap, an attachment ridge to which the desired communication device is attachable proximate the entrance to the communications case, and wherein the suspender strap is attachable to the shoulder strap at a moveable position by means of a shoulder-strap loop in a top end of a shoulder-top section of the shoulder strap through which the suspender strap is extended in contact with a portion of the shoulder strap that is extended from a rear portion of a container-attachment section of the shoulder strap.

2. A personal communication shoulder holster as claimed in claim 1 and further comprising a suspender length adjuster positioned as desired between the waistline end of the suspender strap and a shoulder-strap end of the suspender strap.

3. A personal communication shoulder holster as claimed in claim 2 and further comprising a suspender resilient section positioned as desired between the waistline end of the suspender strap and a shoulder-strap end of the suspender strap.

4. A personal communication shoulder holster as claimed in claim 1 and further comprising a suspender resilient section positioned as desired between the waistline end of the suspender strap and a shoulder-strap end of the suspender strap.

5. A personal communication shoulder holster as claimed in claim 1 and further comprising a case-strap adjuster positioned as desired between the waistline end of the case strap and a case end of the case strap.

6. A personal communication shoulder holster as claimed in claim 1, wherein the attachment ridge to which the desired communication device is attachable for desired containment in the communications case is a slit through which a device attachment member is insertional in a back surface of a container-attachment section of the shoulder strap and at a position proximate the entrance to the communications case.

7. A personal communication shoulder holster as claimed in claim 6 and further comprising a bead on a bottom side of the slit.

8. A personal communication shoulder holster as claimed in claim 1 and further comprising a clip container having an entrance proximate an edge of the attachment ridge on a back side of the communications case.

9. A personal communication shoulder holster comprising:

a shoulder strap constructed of flexible material that is sized and shaped arcuately to lay on top of a shoulder, to encircle down a front side and under an arm to a position adjacent a side and to extend up against a back of the shoulder of a person, a suspender strap constructed of flexible material that is attachable to the shoulder strap at a moveable position and sized and shaped to extend from the back of the shoulder across the back, over an opposite shoulder and down an opposite side to a waistline of the person, a waistline attachment on a waistline end of the suspender strap, a communications case that is sized and straped to contain a desired communication device and constructed of flexible material that is attachable to the shoulder strap at the position under the arm and adjacent the side of the person, a case strap attachable to and extendable clown from a bottom of the communications case to the waistline of the person, a waistline attachment on a waistline end of the case strap, an attachment ridge to which the desired communication device is attachable proximate an entrance to the communications case, a front-strap resilient section of a portion of the shoulder strap which encircles down the front side and under the arm of the person, a front-length-adjustment strap fastener in length-adjustment relationship between the resilient section and a shoulder-top section of the shoulder strap, a rear-strap resilient section of a portion of the shoulder strap which extends from a container-attachment section up against the back of the shoulder of the person, a rear-length-adjustment strap fastener in length-adjustment relationship between the rear-strap resilient section and the moveable position at which the suspender strap is attachable to the shoulder strap, the suspender strap is attachable to the shoulder strap at a moveable position by means of a loop in a top end of the shoulder-top section of the shoulder strap through which the suspender strap is extended in contact with a portion of the shoulder strap that is extended from the container attachment section of the shoulder strap, a suspender length adjuster positioned as desired between the waistline end of the suspender strap and a shoulder-strap end of the suspender strap, a suspender resilient section positioned as desired between the waistline end of the suspender strap and a shoulder-strap end of the suspender strap, and a case-strap adjuster positioned as desired between the waistline end of the case strap anti a case end of the case strap.

10. A personal communication shoulder holster comprising:

a shoulder strap constructed of flexible material that is sized and shaped arcuately to lay on top of a shoulder, to encircle down a front side and under an arm to position adjacent a side and to extend up against a back of the shoulder of a person, a suspender strap constructed of flexible material that is attachable to the shoulder strap at a moveable position and sized and shaped to extend from the back of the shoulder across the back, over an opposite shoulder and down an opposite side to a waistline of the person, a waistline attachment on a waistline end of the suspender strap, a communications case that is sized and shaped to contain a desired communication device and constructed of flexible material that is attachable to the shoulder strap at the position under the arm and adjacent the side of the person, the communications case having an entrance to accept the communication device therethrough, a case strap attachable to and extandable down from a bottom of the communications case to the waistline of the person, a waistline attachment on a waistline end of the case strap, an attachment ridge to which the desired communication device is attachable proximate the entrance to the communications case, the suspender strap is attachable to the shoulder strap at a moveable position by means of a shoulder-strap fastener on a shoulder-strap end of the suspender strap which is attachable to a desired top portion of the shoulder strap having a front shoulder-strap section and a rear shoulder-strap section joined contiguously, and a clip container having an entrance proximate an edge of the attachment ridge on a back side of the communications case.

11. A personal communication shoulder holster comprising:

a shoulder strap constructed of flexible material that is sized and shaped arcuately to lay on top of a shoulder, to encircle down a front side and under an arm to a position adjacent a side and to extend up against a back of the shoulder of a person, a suspender strap constructed of flexible material that is attachable to the shoulder strap at a moveable position and sized and shaped to extend from the back of the shoulder across the back, over an opposite shoulder and down an opposite side to a waistline of the person, a waistline attachment on a waistline end of the suspender strap, a communications case that is sized and shaped to contain a desired communication device and constructed of flexible material that is attachable to the shoulder strap at the position under the arm and adjacent the side of the person, the communications case having an entrance to accept the communication device therethrough, a case strap attachable to and extendable down from a bottom of the communications case to the waistline of the person, a waistline attachment on a waistline end of the case strap, an attachment ridge to which the desired communication device is attachable proximate the entrance to the communications case, and a spring-tensioned reel attached to the communications case and having a line attached to the desired communication device.

* * * * *